US006123647A

United States Patent [19]

Mitchell

[11] Patent Number: 6,123,647

[45] Date of Patent: Sep. 26, 2000

[54] MOTION APPARATUS

[76] Inventor: Andrew John Mitchell, 1630 N. Damen Ave. #3N, Chicago, Ill. 60647

[21] Appl. No.: 09/142,926

[22] PCT Filed: Mar. 20, 1997

[86] PCT No.: PCT/GB97/00785

§ 371 Date: Sep. 17, 1998

§ 102(e) Date: Sep. 17, 1998

[87] PCT Pub. No.: WO97/34663

PCT Pub. Date: Sep. 25, 1997

[30] Foreign Application Priority Data

Mar. 20, 1996 [GB] United Kingdom ..... 9605892
Sep. 4, 1996 [GB] United Kingdom ..... 9618446

[51] Int. Cl.[7] ..... A63B 22/02

[52] U.S. Cl. ..... 482/54; 198/456

[58] Field of Search ..... 482/51, 54; 198/456

[56] References Cited

U.S. PATENT DOCUMENTS 5,238,099 8/1993 Schroeder et al. ..... 198/456

*Primary Examiner*—Glenn E. Richman

[57] ABSTRACT

An omni-directional treadmill providing a surface with no gaps on which a user can move. The treadmill is generated by arranging a set of looped belts (1, 2, 10), each providing at least one elongated surface, abutting one another along the elongate edges provided by the elongate surface. A group of these elongate surfaces defines the treadmill surface. This set of belts (1, 2, 10) is itself arranged in a loop. Movement of the whole set of belts around this loop moves the treadmill surface in one direction. Simultaneous rotation of all the belts (1, 2, 10) providing the surface provides movement perpendicular to the first direction. Using these two components of motion the treadmill can move in any direction indefinetly. Feedback from user can be used to move the treadmill in the opposite direction to keep user in the same place, in the same way a treadmill maintains user moving in one direction in the same place.

20 Claims, 8 Drawing Sheets

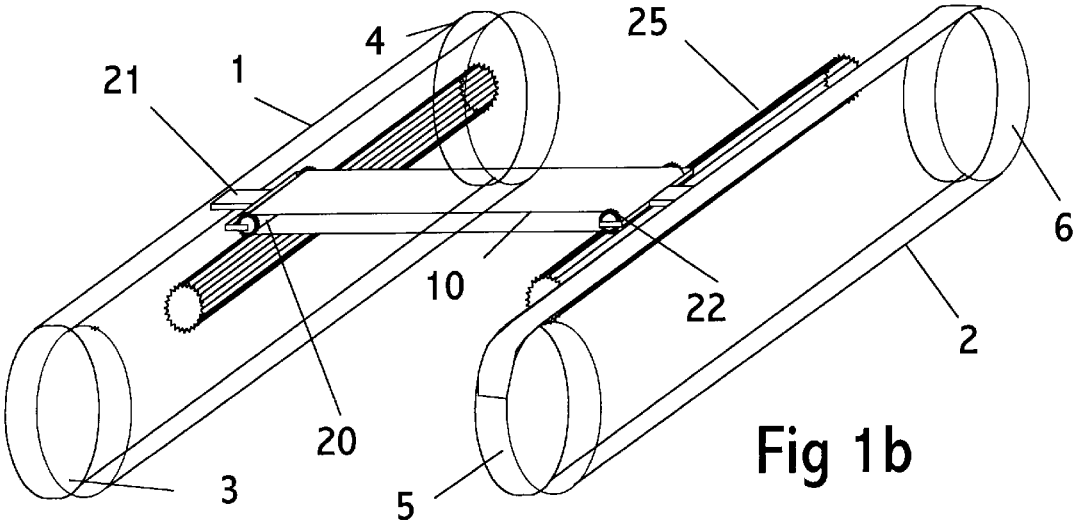
Fig 1b
Fig 1c
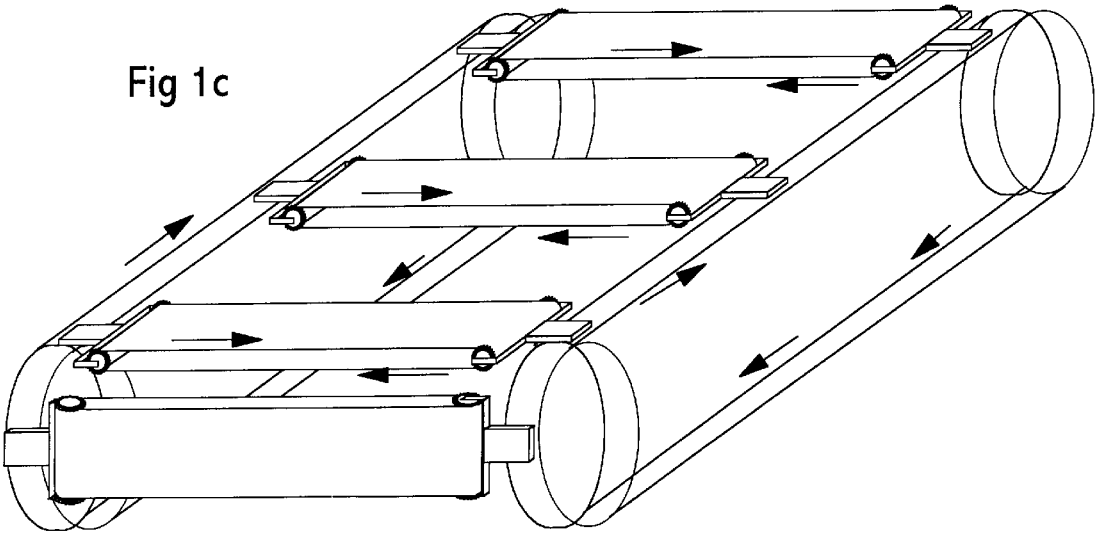

Fig 9a
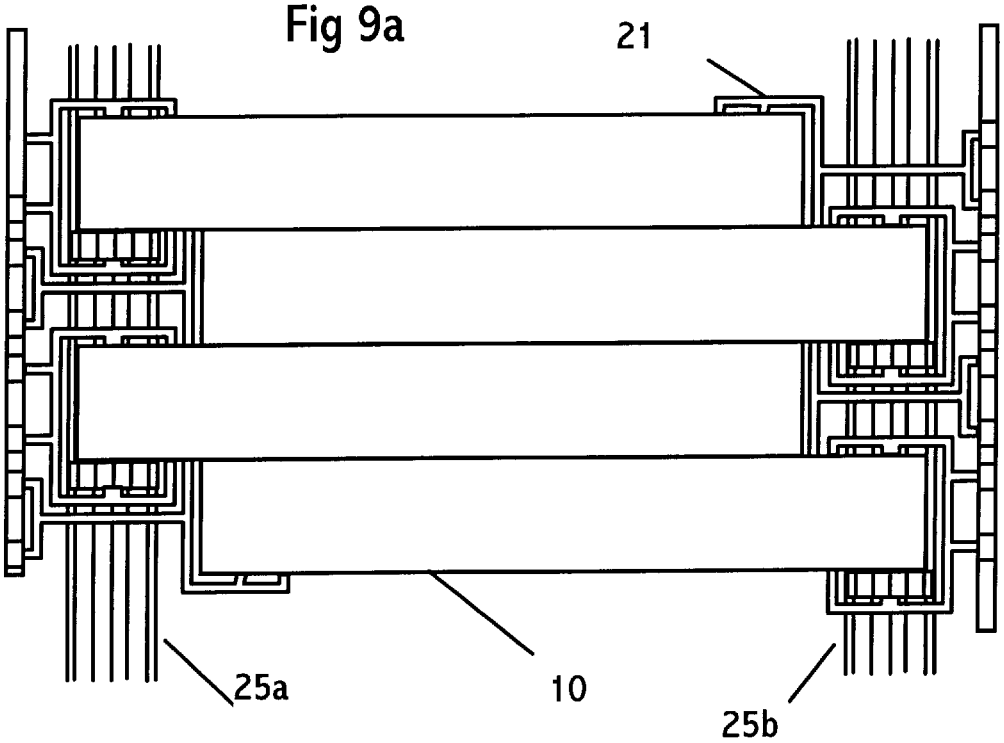
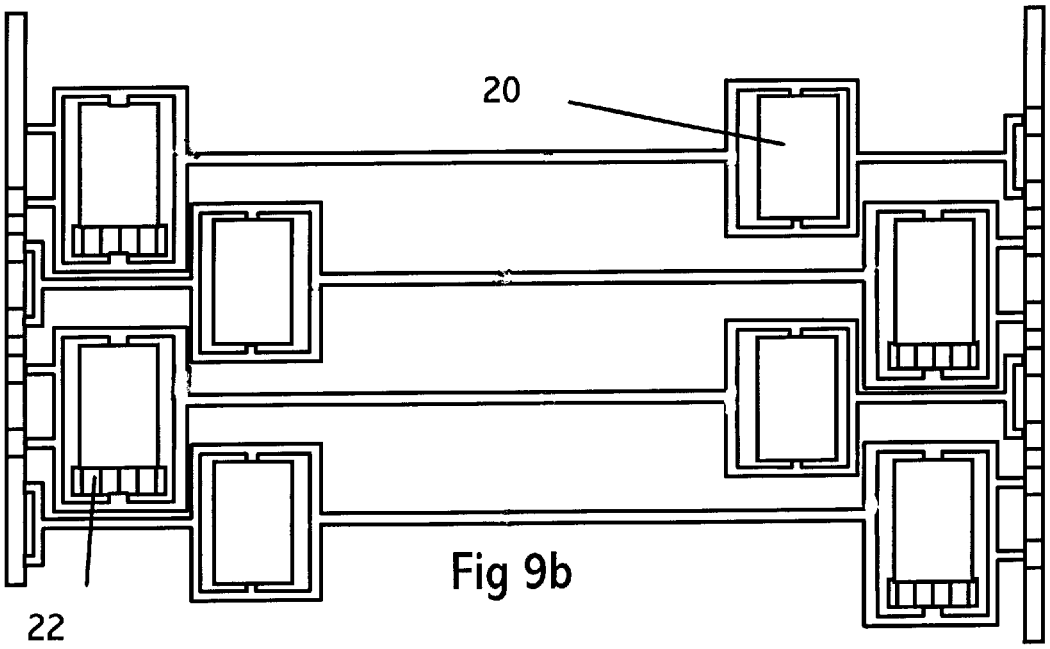
Fig 9b
Fig 10
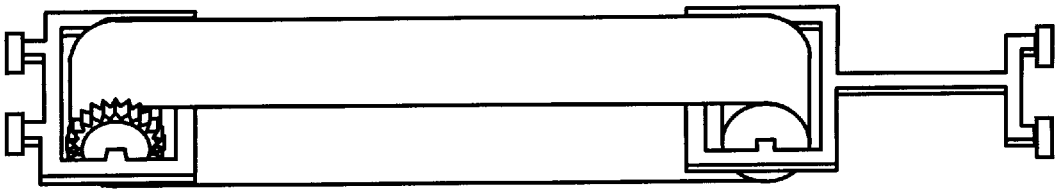

MOTION APPARATUS

This invention relates to improvements in conveyor type devices designed to keep objects which can move under their own force in substantially the same place relative to their environment.

Devices for carrying out this operation in a single dimension are well known. For example, exercise treadmills are designed to travel in the opposite direction to the person thereon, maintaining the same speed as the person is attempting to move. This keeps the person in substantially the same position. Most of these devices employ manual input to the device using a keypad for controlling the speed, which means that the user is constantly struggling to keep his speed the same as the treadmill, rather than the treadmill keeping up with the user. However, treadmills have been designed which monitor the user's position and correct the speed of the treadmill so that the user automatically stays in substantially the same place. A treadmill of this type is disclosed in U.S. Pat. No. 5,314,391.

Single dimensional treadmills have the further disadvantage that the person is confined to move in one direction and that any accidental diversion from this direction can easily cause injury.

In the virtual reality field, users wear a headset to provide a visually realistic three dimensional image of a computer generated environment. The head can be moved, and sensors allow the computer to change the view appropriately. This, in principle, could give very realistic simulations of vehicles in which the user would not normally move from his seat. If it were desired to make scenarios in which the person would want to move around more realistic, means would have to be supplied to allow the person to move around freely without hitting walls in the real environment of which the user is unaware. The problem is heightened by virtue of the fact that the user is wearing a headset.

Virtual reality machines are available which allow the user to stand up, but these confine the user to stand on a platform enclosed by barriers. Any movement of the user is controlled by a joystick, which is unrealistic and hardly the intended "virtual reality".

Treadmills with visuo-acoustic feedback are also known, for example from U.S. Pat. No. 5,385,519. A person on a treadmill wears a mask which, for example, simulates running on a road. However, running, or even walking on a treadmill without being able to see the belt is clearly very dangerous, as it is likely that a user would drift off the side of the belt.

It is clear that what is needed is a surface which reacts to movement in any direction to keep the user in a set area. To date there has been no disclosure of any concepts which would allow a user to move freely in a virtual world.

In light of the disadvantages of the above concepts, an object of the present invention is to provide an omni-directional treadmill, arranged to move both forward and backward and also sideways, endlessly in both directions or combinations of the two.

A further object of the present invention is to provide an omni-directional treadmill with a continuous flat firm surface with no gaps.

A further object of the present invention is to provide an omni-directional treadmill the size of which is not substantially larger than the usable surface of the treadmill.

A further object of the present invention is to provide an omni-directional treadmill which is of a large enough surface area to allow slow acceleration of the user without the user reaching the edge of the surface, thus not excessively accelerating the user's feet, and minimally unbalancing the user.

A further object of the present invention is to provide an omni-directional treadmill responsive to the motion of a user so as to keep the user within a defined area regardless of where the user moves.

According to an embodiment of the invention at present preferred there is provided apparatus arranged to simulate a boundless surface comprising means for detecting motion of an object in any direction on a surface, and means arranged to impart a cancelling motion to said object indefinitely in substantially the opposite direction to the motion of the object whereby to keep said object within a defined area, regardless of the direction and distance the object propels itself along the surface.

According to another embodiment of the invention at present preferred there is provided apparatus comprising a plurality of transverse belt means arranged side by side in a row, each transverse belt means being formed into a loop, wherein each of said transverse belt means provides an elongate surface formed by a portion of the length of the transverse belt means whereby the row of elongate surfaces thus produced in combination provide a single load bearing surface, further comprising means for driving each of said transverse belt means around its loop, means for moving said transverse belt means along the row, and means for moving each transverse belt means from one end of the row to the other end, so as to allow the continuous movement of the transverse belt means along the row, the row of transverse belt means remaining in substantially the same location.

The term "belt" in this specification, apart from in the specific embodiments, is simply intended to mean any type of physically realised loop such as a belt or a looped chain. Similarly, the term "roller" is not just intended to mean a smooth circular cylinder but any object which can rotate to allow the rotation of a belt passed around it, such as a cog or even a set of struts radiating out from a hub. The first belt means could easily be a single belt, and need not be two or more, although the currently preferred embodiments do employ two first belt means.

By an advantageous development of the invention the position and possibly speed of a user placed on a surface defined by said plurality of belts is sensed. This position and speed is then used to control the motion of the surface defined by the belts in a transverse and longitudinal direction so as to keep the user within the bounds of the moving top surface, and/or in substantially the same place in the environment around the apparatus.

Embodiments of the present invention will now be described with reference to the following drawings in which FIG. 1*a* shows a first embodiment of the present invention.

FIG. 1*b* shows the first embodiment with several parts removed to give a clearer view of the embodiment.

FIG. 1*c* shows the first embodiment with several parts removed intended to show an example of the motion of the apparatus.

FIG. 9*a* shows an overhead view of a plurality of belt units of the fifth embodiment of the invention.

FIG. 9*b* shows an overhead view of the plurality of belt units of the fifth embodiment with the belts removed.

FIG. 10 shows a perpsective view of a single belt unit of the fifth embodiment.

Figure 1A:
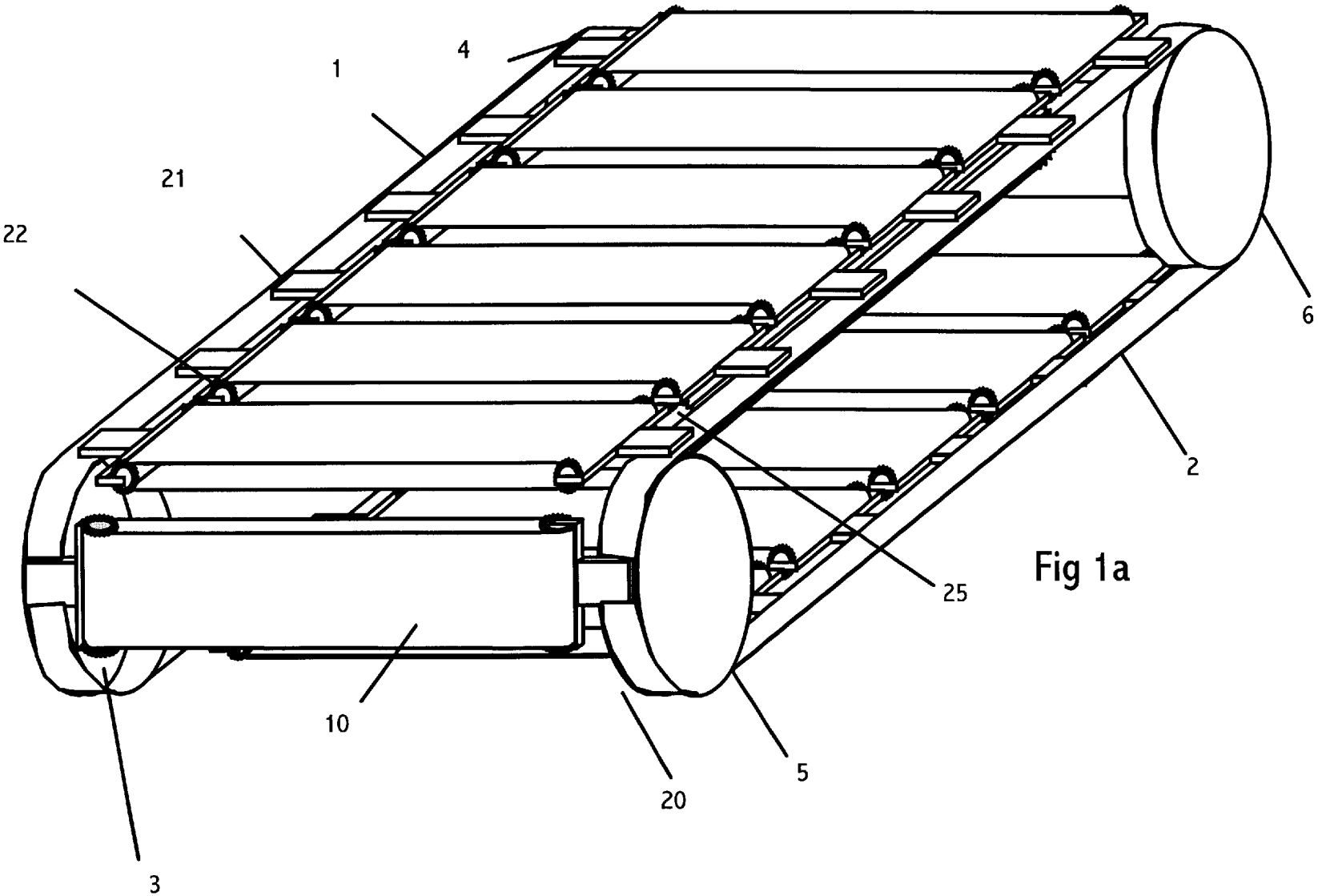

A first embodiment of the invention will now be described with reference to FIGS. 1*a*, 1*b* and 1*c*. FIG. 1*a* shows a first embodiment of the invention with all the principle parts in place. Motors and support members are not shown for reasons of clarity. FIG. 1*b* is a diagram with several of the transverse belts and rollers removed to show parts otherwise invisible. FIG. 1*c* also shows the invention with several parts removed, and is provided with arrows to represent an envisaged example of movement of all the belts.

Two belts 1, 2 hereinafter referred to as longitudinal belts, each wound round two wheels 3,4,5,6 run parallel to one another, opposite one another in an equivalent arrangement to vehicle "caterpillar tracks". In this embodiment the belts are constructed from a resilient, bendable material. Means 7, hereinafter described as longitudinal motors, are provided for supplying torque to at least one of the wheels holding each of the longitudinal belts so as to move the belts at substantially identical speeds in the same direction in the same manner as the belts of an escalator. The longitudinal motors 7 have control means for allowing torque to be supplied clockwise or anticlockwise giving rotation over a range of speeds. These belts and wheels are all held using a frame to keep the mechanism free of the surrounding environment.

Figure 2:
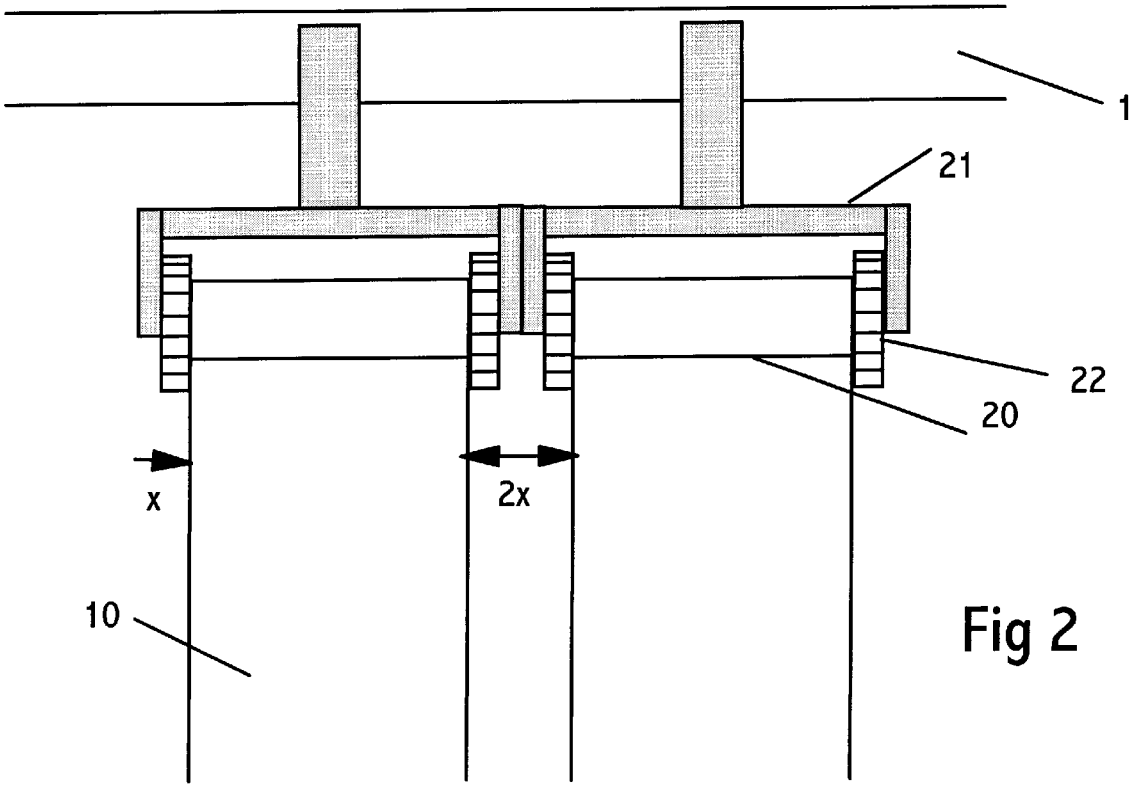
FIG. 2 shows an overhead view of the transverse roller holders of the first embodiment.

Attached to the longitudinal belts at regular intervals are transverse belt roller holders 21 arranged to hold rollers 20 with their axes substantially parallel to the longitudinal belts. These rollers all lie along a common axial loop, whose locus is similar to but slightly larger than the locus of the longitudinal belts due to slight raising of the holders outside the loop defined by the longitudinal belts. The rollers' axes all lie on two vertical longitudinal planes within the planes defined by the longitudinal belts. The transverse belt rollers 20 attached to one longitudinal belt all have counterparts attached to the other longitudinal belt in corresponding positions, so that transverse belts 10 can be run around them to define a set of transverse surfaces 30 on the top of the apparatus. The transverse belt rollers 20 have cogs 22 attached to both their ends of slightly larger radius and common axis. Each cog 22 on a roller must not interfere with the transverse belt 10 attached thereto. Therefore, as shown in FIG. 2, there must be a gap of at least twice the combined width of the cog and the thickness of the transverse belt roller holder (2×) between consecutive belts .

Elongate cogs 25 run along the length of the two longitudinal belts and have teeth which are appropriately shaped to engage the cogs 22 on the transverse belt rollers, and supported so as to engage the cogs of the rollers running along the straight upper part of their path. Means are provided for allowing snag free engagement of the cogs as they reach the elongate cogs, such as tapering on the ends of the elongate cogs.

Means 8, hereinafter referred to as the transverse motor, are provided for applying torque to the elongate cogs.

In modifications of this embodiment, a single elongate cog is provided running the length of one of the longitudinal belts. A single elongate cog provides the advantage that the whole apparatus requires less parts, and that problems synchronising the two elongate cogs are avoided. However it leads to asymmetry which could be disadvantageous. It should be stressed that there is no reason why the belt roller should not have one cog 22 only, or that each transverse belt 10 should not only be provided with a single cog 22 on one of its rollers, as is the case in several of the later embodiments.

Rotation of the longitudinal belts generated by the longitudinal motor 7 results in the rotation all the transverse belts in a longitudinal loop, in a similar fashion to an escalator. As the longitudinal belts 1,2 rotate and bring a transverse roller upward round one of the wheels 3,4, the transverse roller and its associated cogs start to travel in a horizontal direction. As this is occurring, or shortly thereafter, the cogs 22 are arranged to engage the elongate cogs 25. The cogs then run along elongate cog keeping engaged along its length. Continued motion of the longitudinal belts in the same direction will eventually lead to the cogs reaching the end of the elongate cog and disengaging in a similar manner. It can be seen that this pattern of events will happen with all the rollers and will not be affected by the longitudinal belts changing direction.

As the cog teeth run parallel to this motion when they are engaged with the elongate cog, little friction is generated between them.

Rotation of the elongate cog generated by the transverse motor 8 causes the transverse belt rollers 20 powered thereby (ie most of the upper surface belt rollers) to rotate, and accordingly causes all the transverse belts 10 attached thereto to rotate in a transverse direction. Only the transverse belts with rollers engaged with the elongate cog will rotate.

Furthermore any combination of either of these types of rotation are possible, so the upper surface of the device can move in any direction indefinitely.

It has already been established that according to the first embodiment of the invention a gap of twice the cog width is inevitable between the transverse belts 10. This could be overcome to an extent by only using a single cog on each roller as in the following second embodiment, which would still be capable of rotating the belt (although making the torque applied to the transverse belts 10 less distributed and balanced), but a gap would still be present. Many applications of this device would require that no gap be present in the surface defined by the transverse belts 10.

One method of completely eliminating this gap is to stagger consecutive transverse roller holders 21 in a direction perpendicular to the longitudinal axis (ie up, down or transversely).

Figure 3:
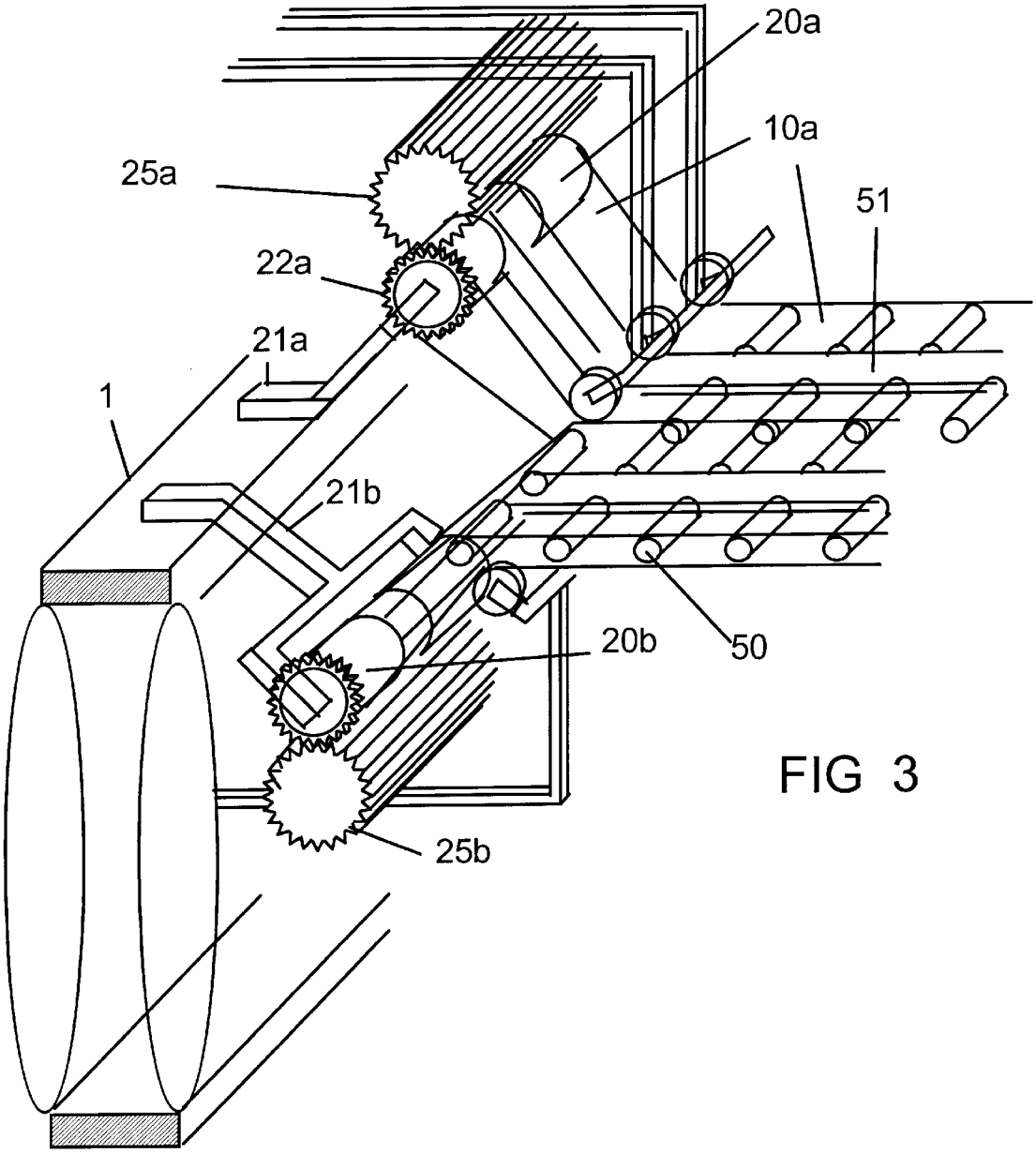
FIG. 3 shows a perspective view of the ends of two consecutive belts according to the second embodiment.
Figure 4:
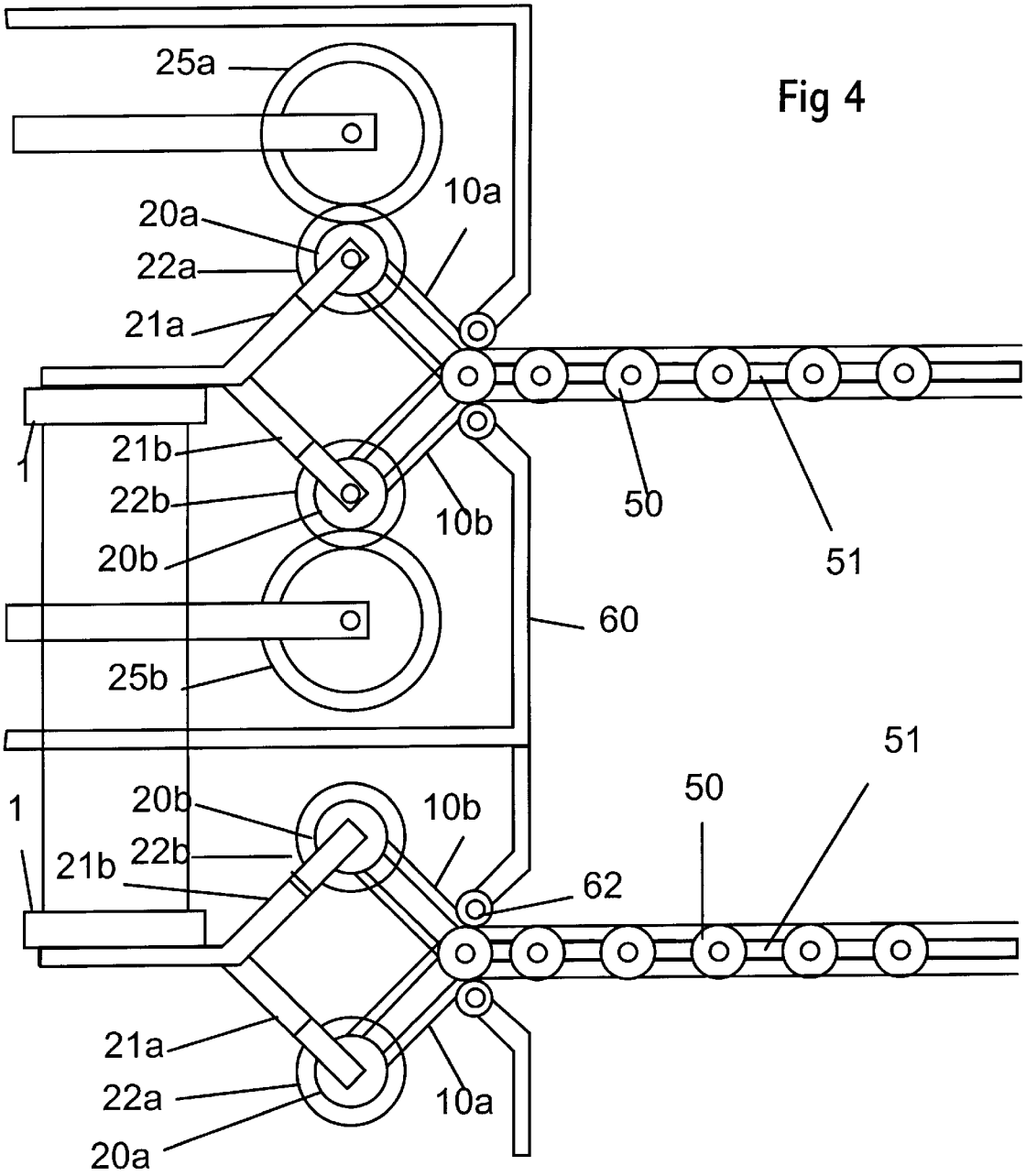
FIG. 4 show a cross section in the transverse direction through the second embodiment.

The second embodiment described hereinafter and shown in part in FIGS. 3 and 4 accomplishes this by staggering consecutive transverse belt rollers 21*a*, 21*b* in an up/down direction. The main portions of all the transverse belts still lie in the same horizontal plane so as to create an even surface for the user to use.

In this embodiment, the transverse belt roller holders 21 are alternately angled upward 25*a* and downward 25*b*. Both FIGS. 3 and 4 show one of each of these types of belt roller holders. In this embodiment two elongate cogs 25*a,b* are required, one to engage with the upward inclined roller holder and one to engage with the downward inclined roller holder. In this embodiment, the upper elongate cog 25*a* can easily be supported from the left side, and the lower cog 25*b* can be supported using supports running through the gap between the two wheels 3 and 4 and the longitudinal belt 1. In this embodiment each of the transverse belt rollers 20*a,b* only have one cog 22*a,b* attached so as to reduce friction and lessen the number of protuberances around to interfere with one another. To bring alternate transverse belts to the same plane, each end of each transverse belt 10 is angled.

In this embodiment a support is also provided along the centre of each of the transverse belts. Rollers 50 of higher diameter than this support protrude along its length as shown most clearly in FIG. 3. These allow the transverse belts 10 to move substantially frictionlessly across them. Furthermore, by having the support along the centre of the belt, rather than along each side, the rollers can support the edges of the transverse belts, thus keeping them from being forced downwards by localised pressure and from leaving gaps along the edges of the belts down which objects could be inserted; inserting objects into the gaps along the edges could lead to items jamming the mechanism or at worst, users' limbs getting caught in the mechanism. It is straightforward to attach the support to the centre portion of the roller spindles at each end of the transverse belt with very little friction. Note that this means that the transverse rollers 20*a,b* at each end are in fact split into two. These can be kept free of the surrounding supports using bearings and or rollers. As described thus far, when a transverse roller belt forms an upward facing trapezium; the transverse belts would naturally hang down underneath or if taught, would form the same trapezium shape. This would waste valuable volume inside the apparatus which could be used for such things as the control means. This volume wastage can be avoided by inserting supports 60 from the directions shown in FIGS. 3 and 4—these being from above, from below, or from between the wheels 1 and 2. Free rotating rollers, or low friction rollerballs similar to those used in deodorants are attached to the end of these supports, to allow movement of the transverse belts past them in transverse and or longitudinal direction with little friction.

In a modification of the embodiment, rails 70, not shown in the figures to avoid cluttering, are used to support the transverse belt roller holders. Wheels 72 are attached to the bottoms and/or tops of the holders 21*a,b* which run on the rails supporting the holders above and below the axis of the longitudinal belts. Note that these rollers only have to be able to run in the longitudinal direction and not freely rotatable like the rollers 62.

Figure 8:
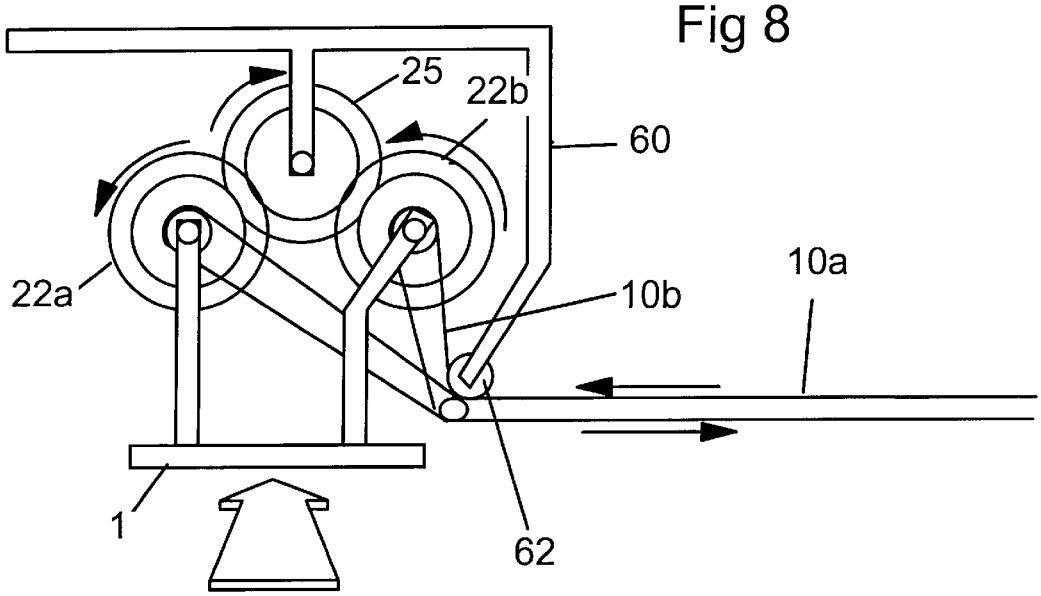
FIG. 8 shows a side view of a fourth embodiment of the invention.

It should be noted that in this embodiment a single elongate cog in between the two sets of rollers cannot be used because the transverse belts 10 and roller holders 21, in motion, would completely surround the elongate cog, so that it could not be supported. If the alternate transverse roller holders were arranged alternately to the left and right of each other, rather than above and below each other, a single elongate cog, somewhere between the two roller axes could be used. An embodiment of this nature is shown in FIG. 8. In this Figure, two rollers 20*a*, 20*b* are shown end on. Both are powered by a single elongate cog 25.

Figure 7:
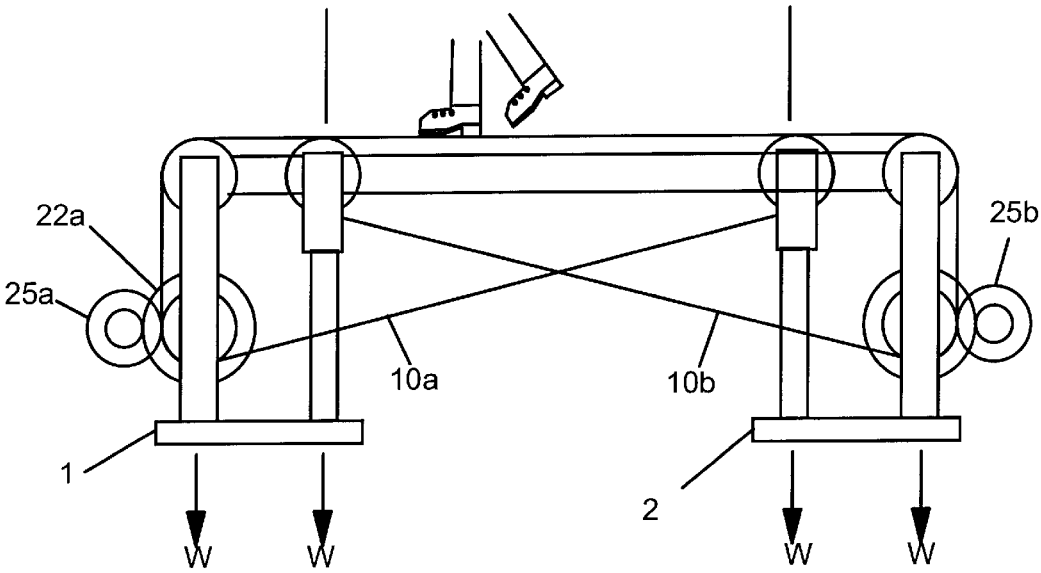
FIG. 7 shows a side view of a third embodiment of the invention.

Furthermore, in certain embodiments, for example those shown in FIG. 7, 9 and 10 the longitudinal belt rollers can be supported from directly above (or below when the rollers are underneath the axis of the device); rails will then not be necessary as it can be arranged that no torque is exerted on the roller holding assemblies.

A better way of minimising the torque on the belt roller holders 21 is to make each belt and its associated roller holders a single rigid unit, as is done in the fifth embodiment of the invention.

FIGS. 9*a* and 9*b* show a plurality of belts units of the fifth embodiment of the present invention, while FIG. 10 shows a single transverse belt unit of this embodiment. The complete apparatus according to this embodiment would have sufficient of these units to provide a closed loop as in the other embodiments. Each of the belt units of this embodiment are supported by a single frame unit, providing a strength advantage and meaning that both ends can be supported without exerting a torque on their supports. The frame supports two transverse belt roller holders 22*a* and 22*b* which in turn support a transverse belts. By only using two belt holders am intrinsically flat profile transverse belt unit can be obtained, the thickness of a belt unit thus being close to the diameter of the largest of the transverse belt rollers which need not be the same diameter. If the belt units are arranged to move around the ends of the longitudinal loop without flipping over, as is envisaged in modifications of these embodiments, instead remaining flat, the height of the treadmill need only be twice the diameter of the belt rollers. However, if the transverse units do flip over at the end, the height of the treadmill is determined instead by the width of the transverse belts. The topology of the frame allows belts of opposite orientation to be placed next to one another without leaving a gap between belts, and allows a cog on one of the transverse belt roller holders to be externally accessible. However, there is no way of providing a cog on one of the belt rollers in each unit and so means for driving cogs along both sides of the apparatus are required (assuming the rollers are externally driven), rather than the single means of the embodiment shown in FIG. 8. This embodiment is also ideally suited to running along rails rather than (or as well as) being carried by one or more longitudinal belts 1,2. The rails can then provide support while a belt provides the driving means for the units. Wheels 72 are therefore also provided at each end of each unit's frame to support the unit. Opposing wheels at each end of the frame are in register so that the wheels run correctly on the rails. The transverse belt is supported either by a flat, low friction board or by rollers as in the previous embodiment, attached to the frame supporting both the transverse belt rollers of each transverse belt unit.

This embodiment has the further advantage that it allows the top belt surfaces to be the highest parts of the whole device, which will make it safer, as no high lip is necessary which could impede a user mounting and dismounting the device.

While all the embodiments shown thus far describe the transverse belt rollers being inside the planes defined by the longitudinal belts, other embodiments of the present invention have them outside the planes of the longitudinal belts to give easier access to drive them. This has the disadvantage of making the whole apparatus inherently wider relative to the size of the available surface.

All the embodiments of the examples show the transverse belts running at substantially the same height as the longitudinal belts. The embodiments were shown this way to make them easier to understand, but there is no reason why they shouldn't run at a larger radius (i.e. with top surface higher relative to the top edges of the longitudinal belts) than the longitudinal belts, which would mean that the edges of the transverse belts would be less likely to snag against one another when rotating round the ends of the device.

In another embodiment of the present invention, more than two of the main belt wheels (3,4,5,6) are used to support the longitudinal belts, though this would leave less room to introduce other features of the invention through the apertures (17,18) defined by the longitudinal belts. These apertures are the only route through which necessary features such as the inside rails (23) for the transverse belt rollers , transverse belts and the elongate cog or cogs (25) can be introduced into the volume swept out by the moving parts, so it is advantageous to keep obstacles in the apertures to a minimum.

In the embodiments in which the longitudinal belts run on rails rather than being supported by belts, such as the fifth embodiment, distributing the weight of the longitudinal belt assemblies is not an issue.

While not shown in any of the figures, embodiments described which employ engaging cogs could employ cogs which taper at the ends so as to ease engagement of the roller cogs 22 and the elongate cogs 25. Synchro-mesh could also be employed on the cogs to ease engagement. It should be noted that there should not be significant resistance to the initial engagement of the elongated cogs 25 and the small cogs 22, because at the point of engagement, the transverse belt in question will not be active. Accordingly, this part of the surface should not be accessible to the user so that the user cannot add any inertia preventing the acceleration of the belt; in practice this would be achieved by protecting this area of the surface by a cover for aesthetic and safety reasons. Thus, the user could not give any inertia to the rotation of the belt. Full synchro-mesh might therefore be excessive in engaging the cogs in most usages. Alternatively, the transverse belt rollers provided with cogs can easily be sprung to allow the cogs to have radial give in them so that they can move away from the elongate cog as necessary. Furthermore, the cogs can be arranged to be lifted away from the elongate cog slightly at each longitudinal end, for examples using raised rails, so that the cogs aren't forced to engage entirely tangentially. This would have a similar effect to tapering the ends of the elongate cog.

Other embodiments use cogs with teeth that are angled with respect to the axis of the cog instead of parallel thereto. This type of cog is common in high torque situations which might occur in the present invention if it were to be used for heavy loads. This would not cause any significant problems, but it is clear that if, for example, the longitudinal belts were rotating, and the elongate cog was not, the angling of the teeth would cause the rotation of the transverse rollers. Thus it can be seen that a rotation proportional to the speed of the longitudinal belts would have to be added to the rotation of the elongate cog to compensate.

There is no reason why single elongate cogs need be used along the whole length of the active surface of the apparatus. Separate independent cogs, possibly of varying speeds, could be used along the length but all would need powering and all would need to have engagement means to allow the smooth engagement of the roller cogs and avoid the mechanism locking up. If either the cogs on the rollers 22 or the powering cogs 25 (or both) had variable radius giving a convex surface this could easily be accommodated.

In another modification of the embodiments of the invention described, in addition to the engagement of teeth to generate the engagement between the transverse roller driving means and the transverse belt rollers, small rollers or bearings are incorporated in the surface thereof to lessen friction. These could also directly drive the transverse belts themselves by friction, rather than the rollers. It would even be feasible to arrange the elongate powering means 25, which might no longer be a cog, to engage the transverse rollers using only bearings, thus removing any inherent friction; the passing of the cogs past one another is the only part of the invention which fundamentally has any significant friction.

In other modifications of the embodiments described, the whole elongate cog principle could be avoided by fitting each of the transverse belts with their own driving motors. Power could easily be distributed to these motors (which would be in place of, or drive, the cogs on the rollers) via power rails running along the length of one of the longitudinal belts. Electrically conducting brushes could supply power to these rails. No surfaces then slide past each other, reducing friction almost completely.

In further modifications of the embodiments described the elongate cog is replaced by a very wide toothed caterpillar track arrangement. This has the advantages that it can be used to more easily power non aligned cogs on the transverse belts as the caterpillar track can be arranged to follow any looped path necessary. Also a caterpillar track can be arranged to have variable flexibility more easily than an elongate cog, and so arranging for the transverse cogs to engage the caterpillar track could be more straightforward than intermeshing two cogs.

It should be noted that in all embodiments and modifications, friction could be overcome in whatever mechanism is used to drive the transverse belt mechanism using strong materials of low friction and/or oil. Whatever frictional systems are usually used to help gearboxes run smoothly could also be used with the present invention.

Equivalents to all the embodiments described thus far could be generated with counterparts to any or all of the parts such as rails and elongate cogs on both of the longitudinal rollers rather than just one to improve balance between the torques being applied to all the rollers. A smaller torque applied to all the rollers will lead to less slip than a large torque only applied to some of the rollers.

Furthermore, as mentioned earlier, in modifications of all the embodiments described, the longitudinal belts can be replaced by rails. A driven mechanism is provided on each of the transverse belts to move the transverse belts around the rails defining the path of the belts.

If the belt units run on rails it can easily be arranged that they move independently and therefore it can be arranged that once a transverse belt unit has moved past the usable area and is therefore not in use, it can be arranged that it moves swiftly to the other end of the apparatus on rails below the top surface and quickly "catches up" with a belt unit which has just moved into the usable area, so that it is ready to move into the usable area itself as motion continues. According to this modification, the number of transverse belt units can be cut down by around a factor of two: Clearly different numbers of transverse belt units, excess to the ones needed to define the surface at any particular time, can be used as appropriate.

Figure 5A:
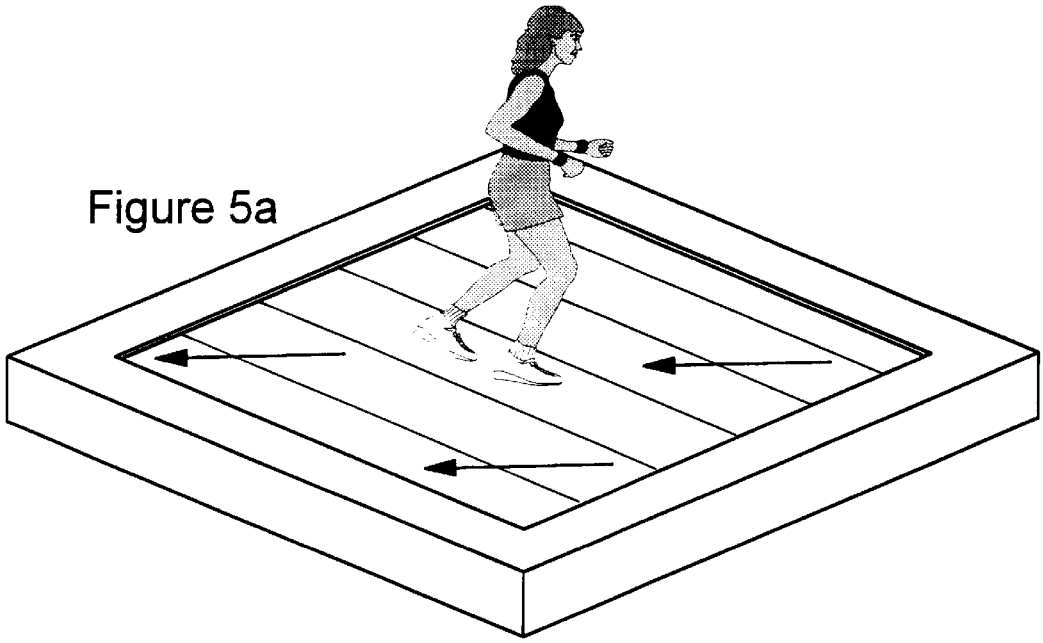
FIG. 5 shows a view of an embodiment as it could be used in the field of virtual reality.
Figure 5B:
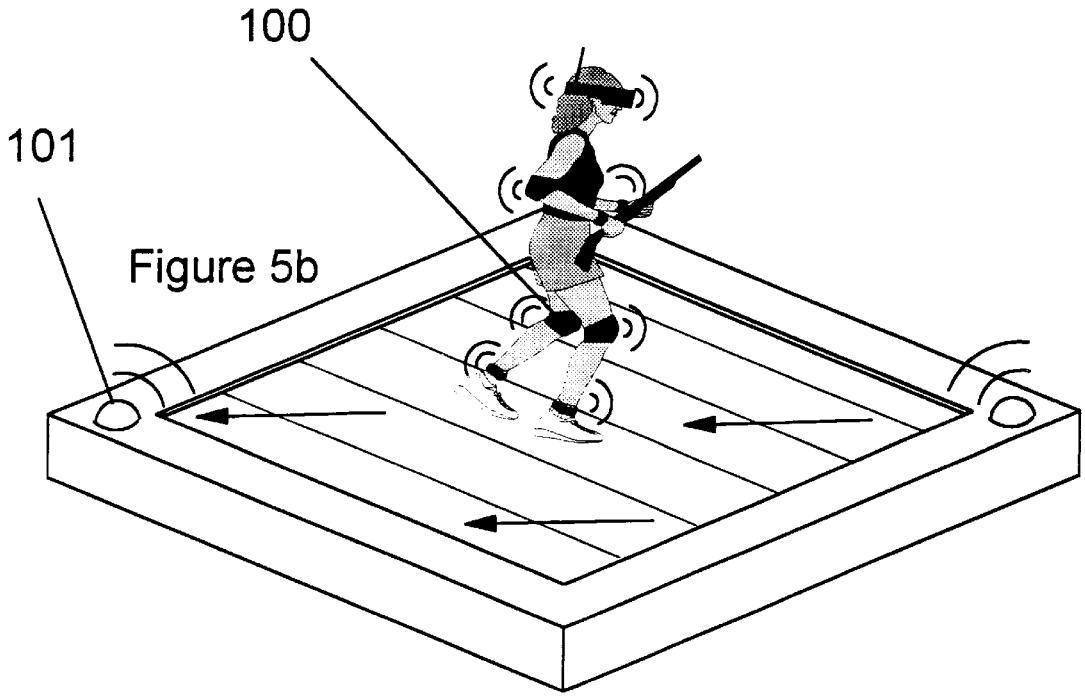

In all embodiments of the present invention, sensors can be employed, taking information from the user located on the top surface defined by the transverse belts to keep the user in the same place by moving the treadmill in the opposite direction. An example of a treadmill of this nature according to the present invention is shown in FIG. 5*a*. This information could consist of, for example, the position of the user, the speed of the user and the position/speed of different parts of the user. There are many ways that this information could reach the control means for the apparatus. Transponders, reflectors or transmitters could be used, as in many current virtual reality applications. These would be attached to straps on parts of the user. Doppler sensors, beam breakers, or pressure sensors could also be used using IR, ultrasonic or other types of transmission. FIG. 5*b* shows an embodiment in which a user carries transmitters or transponders 100, and transmits signals to receivers/transmitters which use such signals to judge the position of the user, and can transmit information to active articles worn by the user.

The list of possible sensing means is huge. Combinations of these means could also be used to establish the user's position and/or speed. It allows users to walk or run freely in a virtual world, as shown in FIG. 5, while wearing a headset. There is no reason why a person wearing a virtual headset or any other "virtual reality" equipment should be physically linked to any other equipment. Information, such as images could be transmitted to the headset using transmitters 101 around or under the treadmill, which could receive video signals in much the same way as a miniature television set. The headset could even process its own video signals using position cues transmitted to it. Body positions could be transmitted to sensors using transponders or transmitters on the body. Any monitoring and processing equipment could be stored, for example, underneath or inside the mechanism of the apparatus according to the invention. Many of the sensing means discussed could be operated very close to, or even below surface level, and there is therefore no reason why the apparatus should be significantly higher than the upper surface defined by the transverse rollers if this is required.

Furthermore, there is no reason why the user should have to wear a virtual reality headset; in other embodiments the images would be projected onto screens around the room (possibly using stereoscopic spectacles) to provide the 3-*d* feeling for the user.

Furthermore, there is no reason why users need be human. Animals or even vehicles could run on apparatus of various sizes according to the present invention. This could have applications in animal training or learning to drive vehicles. Vehicle simulators would not be necessary; the actual vehicle could be used in the testing. It is even possible to ride a real bicycle on the surface provided by the present invention.

In all of the embodiments described thus far the transverse and longitudinal motion, both controlled independently can be controlled by signals being passed from a user (this user being any substantially autonomously movable object such as human, vehicle or animal) whereby to cause the surface created by the transverse belts to move in the opposite direction to the user whereby to keep the user within the bounds of the surface. The acceleration of the surface may be significantly damped so as not to cause the user to overbalance, a lag time being available to bring the surface up to the speed of the user by the time the user has reached the edge of the surface. Slightly more speed is required after this to bring the user gradually back close to the centre to allow for any new acceleration or deceleration. In any of the embodiments the ideal "resting" place may be behind the centre of the surface (or any other position depending on the type of user) on the assumption that the user can accelerate more easily forward than backward. Also, depending on the speed of the user, he, she or it might be maintained further forward or backward on the surface depending on his acceleration characteristics at that speed. For example, if the user is a person, and that person is known to be sprinting flat out, it would be advisable to have him as far forward on the surface as possible, so if he tires suddenly, the mechanism has the whole length of the surface to gradually decelerate him.

Figure 6:
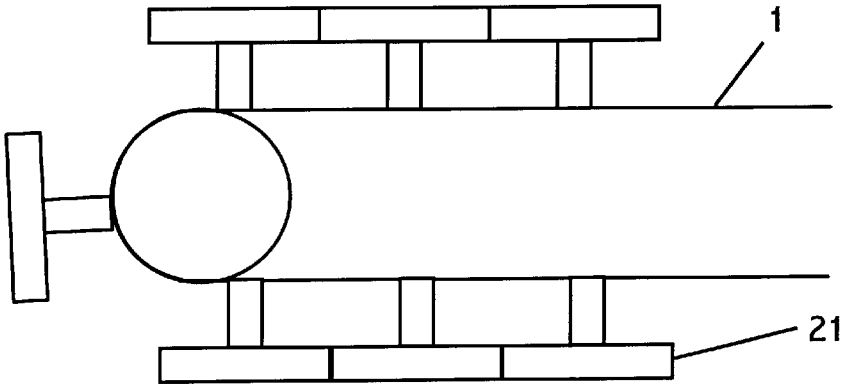
FIG. 6 shows a side on view of two different embodiments with the transverse belt roller holders at different radiuses.
Figure 6:
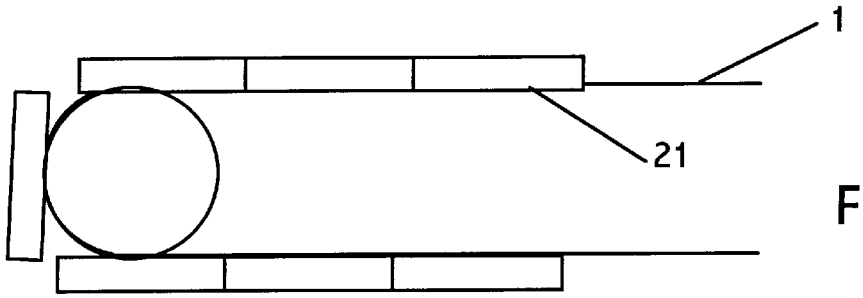

The relative heights of the transverse belts and the longitudinal belts have a significant impact in the design of apparatus according to the invention. If the transverse belts are lifted up to follow a wider longitudinal loop than the longitudinal belts, this will mean that as the transverse belts rotate round the ends of the longitudinal belt path, they will each be further apart, as shown in FIG. 6, thus allowing thicker transverse belt supports and rollers without "things snagging up around the bends". The flip side to this is that more space will be needed to flip the transverse belts over at the ends of their longitudinal runs. Having the belts at approximately the same level, as shown in embodiments 1 and 2 seems to be a reasonable compromise.

It should be noted that the invention is not limited to use for keeping a user within a well defined area. The whole apparatus could instead be used as a driving mechanism for any vehicle in any direction without the vehicle having to turn. For this to be the case, the whole apparatus would sit on a surface without being suspended above the ground.

In other embodiments of the present invention, the surface is curved or angled either by vertical curving of the path of the two longitudinal belts (and equivalent curving of the routes taken by the transverse belts) in a similar fashion to the ends of an escalator, and possibly also by transverse curvature of the path of the longitudinal belts. This would necessitate the transverse belts being formed from an elastic material, and would allow the surface to be a more elaborate shape such as a trapezoid, parallelogram, triangle, or even circle. Naturally the elongate cogs 25 would need to be threaded appropriately especially if different speeds of the various belts were to be accommodated.

In other modifications of the embodiments of the present invention described, the mechanism of the apparatus is mounted on rams to angle the surface away from the horizontal in any direction. This would be carried out in a similar way to current aircraft simulators. In this way slopes could easily be represented using appropriate control.

In other modifications of embodiments of the invention described, more than one apparatus could be racked together and used to represent steps. It should be remembered that the mechanism can be moved in any direction under the user without the user moving in "real space".

There is no reason why the surface should be limited to flat belts of material with plastic properties as described in the specific embodiments. The transverse belts could easily be made, for example, of pieces of wood hinged together underneath or attached to another belt. Thus, as the blocks flip round the transverse belt rollers they would not have to bend, but in the flat sections of the transverse loop, each block would rest snugly against other wooden blocks, giving, in principle a solid wooden surface with no gaps, just joins; A virtual ballroom could be thereby be envisaged. The same goes for any other surface, solid or otherwise, such as grass; it should be noted that a lawnmower placed on this device could mow the defined lawn itself without anything controlling it.

It could be envisaged, in an apparatus according to the invention, that the transverse belts could be releasably attached to the longitudinal belts, and racked in store spaces, so that spare belts giving different surfaces could also be used in the same session on the same apparatus.

Furthermore, there is no reason why loose surfaces such as sand or soil could not lie on a more robust subsurface. The loose material could be sprayed out along edges of the usable surfaces, at rates depending on how fast the surface is moving away from that edge (assuming a fairly smooth thickness is required). As the sand reaches an edge of the moving surface it could be collected in troughs underneath, or, for example "vacuumed" up, either way being recycled if required.

In all of these embodiments any struts running from one side of the apparatus transversely to the other (eg those attached to rollers (50) supporting the transverse belts) could be contractible, e.g. by designing them in a telescopic fashion, which could be put into contracted form for transporting to bring the two longitudinal sides closer together, thus making the whole apparatus substantially linear rather than rectangular. It could then fit through doors if otherwise too large. In its simpler embodiments though, it is quite feasible that the whole apparatus could be constructed from modular units and be put together in the space in which it is to be used, DIY style.

The present invention has vast numbers of applications particularly in the virtual reality industry.

The invention has applications in sports and exercise, simply as an omni-directional treadmill, or when combined with virtual reality concepts as a "virtual sports field". It could be envisaged that whole teams of players could all play for example, football, or basketball in the same game, while all using their own apparatus according to the present invention in different places. Thus, as you can now play chess or other computer games across the world using various communications technologies, you could play virtual Soccer, with friends representing other players, and even computers simulating other, perhaps celebrity, players.

In all of these applications, there is nothing to prevent scenery being introduced by gantries to the side of or above the apparatus to simulate walls, doors windows, balls, people or virtually anything to make the virtual (or real, if the device is being used without headset or other necessary "virtual reality" equipment) landscape more realistic.

For example, in virtual fighting games there is nothing to stop real contact between the user and sophisticated "punch bags" moved to simulate an opponent, or a member of the opposite team in a virtual sport. Making a ball attached to a gantry or fired from one or more possibly moveable launchers around the treadmill behave like a ball moving in virtual space could be envisaged.

The invention also has applications in the field of imprisonment or in encaging animals without enclosures while still allowing them to "roam free". As long as the surface were larger than an imprisoned animal or criminal could jump, he or it could be dragged back to the centre of the surface, or, as already discussed, behind the centre of the surface using data from sensors to calculate where he or it will jump to.

The invention also has applications in the field of simulation of walking through a fixed construction, such as a house, a nuclear power station or an oil-rig, perhaps being mimicked in the real construction by a robot following the same path. For example, the user could have the same view as the robot, which would mimic his movements. This would have applications in rescue situations where speed is of the essence, giving much more intuitive freedom than the current remote controlled robots.

Another application of this invention is as a baby controlling device. The baby can crawl around while being kept safely in the centre of the surface.

It is stressed that the different embodiments and modifications disclosed herein which relate to different aspects of the invention could be used in different combinations to obtain the desired operation of the invention for the appropriate purpose.

What is claimed is:

1. Apparatus arranged to provide a continuously moveable surface moveable in any direction within a defined area, comprising a plurality of belt units each comprising a transverse belt forming a loop, each said belt unit, when in a first configuration, holding said transverse belt to permit rotational movement of said belt; said belt, when in said first configuration, having a substantially straight upper portion relative to said belt unit, the direction of rotational movement of said upper portion oriented along the length of said belt unit; wherein a changeable subset of said belt units are arranged in said first configuration in a row with the length of each belt unit proximal each immediately adjacent belt unit along a substantial portion of its length, the length of said belt units all oriented in a first direction; and wherein said substantially straight upper portion of each said transverse belts in said row provide an elongate surface comprising a portion of the length of the respective transverse belt and wherein said elongate surfaces arranged side by side in combination provide a surface over said area, further comprising first driving means for driving each of said transverse belts of said subset of said belt units in either direction along its length, second driving means for transporting said subset of belt units across said area, either in a second direction not parallel to said first direction or in a direction opposite said second direction, for removing a belt unit from one end of said row when the upper portion of the belt no longer lies in said area, and for introducing a belt unit, in said first configuration, onto the opposite end of said row, to form a new subset in said changeable subset of belt units in a row;

means for detecting motion of an object in any direction on said surface; and wherein said first driving means and said second driving means are arranged to transport said belt units and move said transverse belts such that said continuously moveable surface counteracts the motion of said object whereby to maintain the object within said area.

2. Apparatus according to claim 1 wherein said second driving means includes at least one longitudinal belt; wherein said plurality of belt units engage said longitudinal belt, and wherein said second driving means includes at least one motor to drive said at least one longitudinal belt in said second direction or said direction opposite said second direction.

3. Apparatus according to claim 1 further comprising guide means defining the path of said plurality of belt units in said second direction, and wherein said second driving means drives said plurality of belt units around the path defined by said guide means.

4. Apparatus according to claim 1 further comprising processing and imaging means arranged to provide the illusion of an environment of which said surface forms a part, said processing means using data concerning the motion of the object and outputting image data to the imaging means to create one or more images to present to the object.

5. Apparatus according to claim 1 wherein the object comprises a person wearing a head-mounted display.

6. Apparatus according to claim 1 further providing objects above said surface which said object can interact with.

7. Apparatus according to claim 1 wherein said elongate surfaces arranged side by side abut one another such that the load bearing surface has no substantial gaps.

8. Apparatus according to claim 7 wherein said belt units when arranged side by side are staggered in said first direction.

9. Apparatus according to claim 1 wherein said subset of belt units can be moved into further configurations in which said elongate surfaces are no longer substantially straight.

10. Apparatus according to claim 1 wherein said plurality of belt units form a continuous loop of belt units, said subset of belt units being a consecutive set of belt units in said loop, such that belts are removed from and introduced to said row by movement of said belt units around said continuous loop of belt units.

11. Apparatus according to claim 1 wherein the second driving means comprises a plurality of driving mechanisms each associated with a belt unit to drive the associated belt unit across said area.

12. Apparatus according to claim 1 wherein said transverse belts comprise a plurality of inter-engaging belt defining members.

13. Apparatus according to claim 1 wherein each belt unit is provided with a driving mechanism to drive the associated transverse belt along its length.

14. Apparatus according to claim 1 wherein the belt units further comprise a cog means arranged to engage with an external driving cog, said cog means mechanically connected to the associated transverse belt to drive the transverse belt along its length.

15. Apparatus according to claim 1 wherein said external driving cog drives all said belt units in said row, and comprises an elongate cog running the length of the row in said second direction.

16. Apparatus according to claim 15 wherein synchro mesh is employed to engage and disengage each of said cog means and said external driving cog at each end of the row.

17. Apparatus according to claim 1 wherein said means for detecting motion of said object senses the position of the object and determines the motion of the object according to the change in this position.

18. Apparatus according to claim 1 wherein the apparatus is arranged so that its attitude can be changed for simulation of surfaces of varying attitudes.

19. Apparatus according to claim 1 wherein said apparatus further monitors the motion of various parts of the object independently.

20. A method of simulating a boundless surface comprising:

detecting motion of an object in any direction on a supporting surface, imparting an opposing motion to said object indefinitely in substantially the opposite direction to the motion of the object whereby to keep said object within a defined area, regardless of the direction and distance the object propels itself along the supporting surface; wherein motion is imparted on said object by providing a plurality of surfaces, said surfaces being provided by a changeable subset of a plurality of transverse belts, and said surfaces in combination constituting said supporting surface;

each of said surfaces comprises a substantially straight part of one of said subset of said plurality of transverse belts, the direction of rotational movement of each substantially straight part being along the length of said belt; said subset of transverse belts being arranged in a row with each belt having a substantial portion of its length proximal to each adjacent belt in the row;

said method further comprising detecting motion of an object in any direction on said supporting surface;

driving each of said subset of transverse belts to rotate said belt in either direction along its length, said part of each of said belts either moving in a first direction or a direction opposite said first direction;

transporting said subset of transverse belts across said area, either in a second direction not parallel to said first direction or in a direction opposite said second direction, removing a transverse belt from one end of said row whenever said substantially straight of the transverse belt no longer lies in said area, and introducing a transverse belt onto the opposite end of said row, thereby changing the subset of belts constituting said row;

said rotating and transporting of said subset of transverse belts being performed at such a rate that motion of said supporting surface counteracts the motion of said object whereby to maintain the object within said area.

* * * * *